United States Patent [19]

Rao et al.

[11] Patent Number: 4,825,020

[45] Date of Patent: Apr. 25, 1989

[54] SLIDE SWITCH

[75] Inventors: Chepur P. Rao, North Kingstown; Juan J. Barrena, Providence, both of R.I.

[73] Assignee: Tower Manufacturing Corportion, Providence, R.I.

[21] Appl. No.: 181,663

[22] Filed: Apr. 14, 1988

[51] Int. Cl.[4] ..... H01H 15/00

[52] U.S. Cl. ..... 200/16 D; 200/16 C

[58] Field of Search ..... 200/16 R, 16 C, 16 D, 200/16 B, 16 F, 77, 153 R, 239, 241, 242, 252, 253, 291

[56] References Cited

U.S. PATENT DOCUMENTS

| | | | |
|---|---|---|---|
| 2,762,880 | 9/1956 | Hathorn et al. | 200/16 D X |
| 2,966,560 | 12/1960 | Gluck | 200/16 C |
| 3,072,757 | 1/1963 | Gluck | 200/16 D |
| 3,174,002 | 3/1965 | Golbeck | 200/16 D |
| 3,674,953 | 7/1972 | Brevick | 200/77 |
| 4,035,594 | 7/1977 | McKinney et al. | 200/16 D |
| 4,268,728 | 5/1981 | Rose | 200/16 D X |
| 4,506,119 | 3/1985 | Tanabe | 200/253 X |

*Primary Examiner*—J. R. Scott

*Attorney, Agent, or Firm*—Salter & Michaelson

[57] ABSTRACT

An electrical slide switch includes a housing, first, second and third spaced, substantially aligned fixed contacts in the housing, a movable contact in the housing and a slide member which is operative for moving the movable contact between a first position wherein it is in engagement with the first and second fixed contacts and a second position wherein it is in engagement with the second and third fixed contacts. The movable contact is made from a resilient sheet metal, and it includes an elongated contacting portion having a central bump thereon and a pair of resileient biasing portions which are operative for biasing the contacting portion toward the fixed contacts. The biasing portions include inwardly extending portion which extend integrally inwardly from the ends of the contacting portion to spaced bends and outwardly extending portions which extend outwardly from the bends. The bump on the contacting portion engages the second fixed contact to cause the contacting portion to pivot as it is moved between the first and second positions thereof to provide a positive "break-before-make" operation in the switch. The switch further includes detents which provide a crisp, positive snap-action in the operation of the slide member and alternatively position the slide member in the first or second positions thereof.

12 Claims, 2 Drawing Sheets

SLIDE SWITCH

BACKGROUND AND SUMMARY OF THE INVENTION

The instant invention relates to electrical switches and more particularly to a durable slide switch which is operative with a crisp, positive switching action.

Electrical slide switches wherein a slide member is slidably repositionable to affect a switching action have been found to be effective for a wide range of electrical switching applications, such as in small tools and appliances, and as a result, over the years, a wide variety of different types of electrical slide switches have been developed for use in such applications. In this regard, however, for most applications, it has generally been found that in order for a slide switch to be effective, it should be durable enough to withstand repeated use over a prolonged period of time. Further, a slide switch should be operative with a crisp, positive switching action for making and breaking contact without arcing. Still further, a slide switch should be resistant to dielectric breakdown, and it should be adapted to be readily and easily installed in various tools, appliances, and other devices.

The switches disclosed in the U.S. patents to Bramming U.S. Pat. Nos. 1,740,535; Hill 2,303,693; Geci 2,550,145; Hathorn et al 2,762,880; and Marquardt 3,767,870 are generally illustrative of the types of the electrical slide switches which have been heretofore available and represent the closest prior art to the subject invention of which the applicant is aware. However, since these switches fail to suggest the novel features of the slide switch of the instant invention which enable it to be reliably operated with a crisp, positive switching action, they are believed to be of only general interest with respect thereto.

The instant invention provides a highly reliable and durable slide switch which is operative with a crisp, positive switching action and which is resistant to dielectric breakdown and adapted for use in a wide variety of switching applications. More specifically, the switch of the instant invention comprises a housing which is preferably made of a nonconductive plastic material, spaced, substantially aligned first, second and third fixed contacts in the housing, a movable contact member in the housing, and a slide member which is slidable between a first position and a second position for slidably moving the movable contact member between a first position wherein it is in engagement with the first and second fixed contacts but in spaced disengagement from the third fixed contact and a second position wherein it is in engagement with the second and third fixed contacts but in spaced disengagement from the first fixed contact. The movable contact is integrally formed from a resilient conductive sheet metal, and it includes an elongated contacting portion and first and second biasing portions which extend from the opposite ends of the contacting portion. The biasing portions include inwardly extending portions which are spaced from the contacting portion and extend inwardly in converging relation from the opposte ends of the contacting portion to bends and outwardly extending portions which are spaced from the inwardly extending portions and extend outwardly in diverging relation from the bends. The switch is further constructed so that the slide member engages the outwardly extending portions of the biasing portions to maintain either or both of the biasing portions in slightly resiliently compressed dispositions in order to resiliently bias the contacting portion toward the appropriate fixed contacts. The contacting portion preferably has a substantially centrally disposed bump thereon which extends in the direction of the fixed contacts and passes over the second fixed contact when the movable contact member is moved between the first and second positions thereof in order to pivot the contacting portion slightly as it is moved between the first and second positions thereof so that the contacting portion breaks contact with one of the first or third fixed contacts well before it makes contact with the other. In addition, the switch preferably comprises first and second pairs of detent elements for alternatively releasably retaining the slide member in the first and second positions thereof. In this connection, one of the detent elements of each pair is preferably formed on the slide member, and the other detent element of each pair is preferably formed on the housing, and the detent elements on the housing are preferably spaced apart by a greater distance than the detent elements on the slide member. Further, the detent elements are preferably positioned so that both pairs of the detent elements are in partially disengaged positions when the bump on the contacting portion passes over the second fixed contact and so that one pair of the detent elements is still in a partially engaged position when the other pair of detent elements is moved into a fully engaged position as the slide member is moved between the first and second positions thereof. The switch of the instant invention is adapted to be alternatively constructed as either a single-pole, double-throw switch or as a double-pole, double-throw switch, and when it is embodied as a double-pole, double-throw switch, it includes first and second spaced, substantially parallel sets of first, second and third fixed contacts in the housing and first and second movable contacts which are slidable between first positions thereof wherein they are in engagement with the first and second fixed contacts and second positions thereof wherein they are in engagement with the second and third fixed contacts. Further, when the switch is embodied in a double-pole, double-throw configuration, it preferably includes a track which separates the first and second sets of fixed contacts, and the first and second movable contacts travel on opposite sides of the track and are guided by the track in their movement across the first and second sets of fixed contacts, respectively.

It has been found that the switch of the instant invention has significant advantages over the heretofore available switches, such as those disclosed in the hereinabove cited references. Specifically, the biasing portions of the movable contact member of the switch of the instant invention are constructed so that they can be repeatedly compressed and flexed as the contacting portion of the movable contact member is moved between the first and second positions thereof without causing the biasing portions to lose their resiliencies. Further, because of the configurations of the biasing portions, the bump on the contacting portion of the contact member causes the contacting portion to pivot as the bump passes over the second fixed contact so that a "break-before-make" action is effectively achieved in the switch of the subject invention. Still further, the first and second pairs of detents cooperate to enhance the crisp snap-action of the switch as it is moved between the first and second positions thereof, and they effectively prevent the slide member from becoming "stalled" in an intermediate position.

Accordingly, it is a primary object of the instant invention to provide an improved slide switch which can be repeatedly operated with a high degree of effectiveness over a prolonged period of time.

Another object of the instant invention is to provide a slide switch having a sharp, crisp switching action.

An even further object of the instant invention is to provide an effective slide switch which is not prone to arcing during switching.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
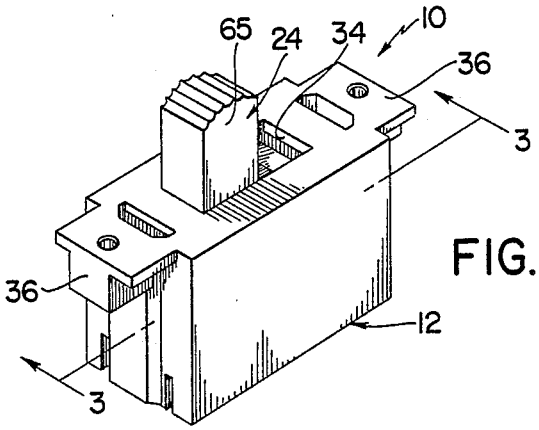
FIG. 1 is a perspective view of the switch of the instant invention.
Figure 2:
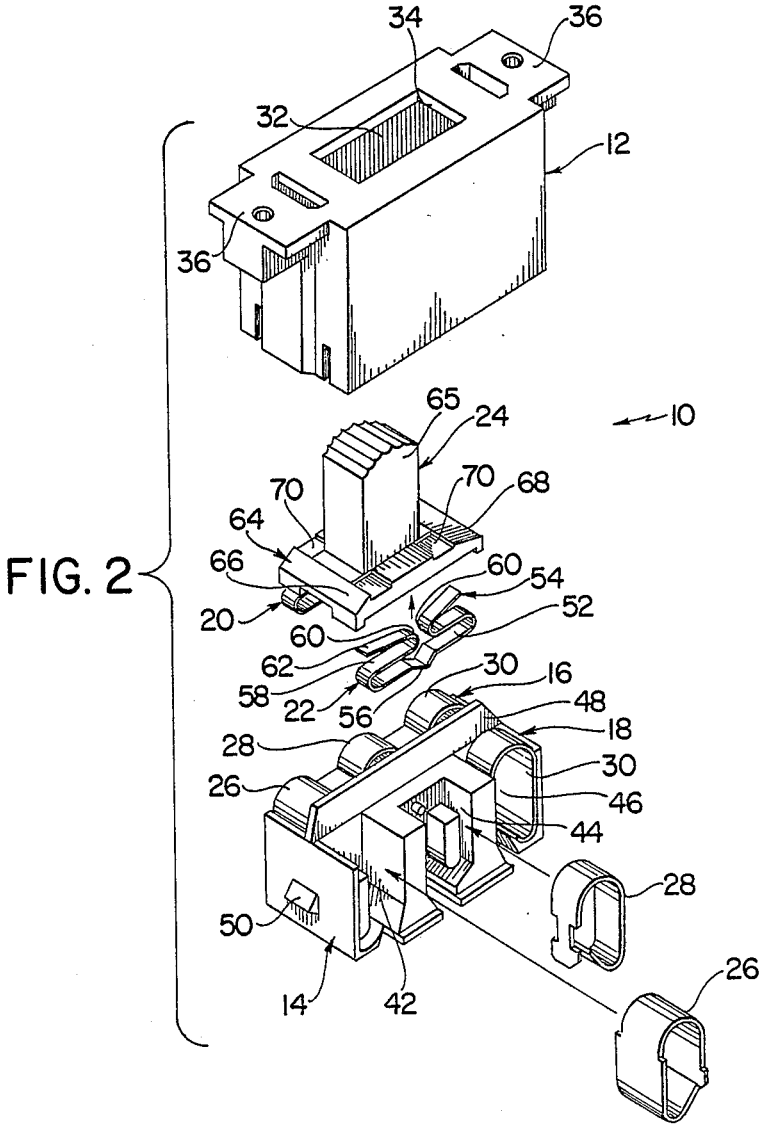
FIG. 2 is an exploded perspective view thereof.

Referring now to the drawings, the switch of the instant invention is illustrated in FIGS. 1 through 6 and generally indicated at 10. The switch 10 comprises a housing generally indicated at 12, an insert generally indicated at 14 in the housing 12, first and second sets of fixed contacts generally indicated at 16 and 18, respectively, which are mounted on the insert 14, first and second movable contacts generally indicated at 20 and 22, respectively, and a slide member generally indicated at 24. Each of the first and second sets of fixed contacts 16 and 18, respectively, includes first, second, and third fixed contacts 26, 28, and 30, respectively, which are mounted on the insert 14 in substantially aligned relation. The slide member 24 and the first and second movable contacts 20 and 22, respectively, are mounted so that they are movable between the first positions thereof illustrated in FIG. 3 wherein the first and second movable contacts 20 and 22, respectively, are in engagement with the first and second fixed contacts 26 and 28 of the first and second sets of fixed contacts 16 and 18, respectively, and second positions thereof illustrated in FIG. 6 wherein the first and second movable contacts 20 and 22, respectively, are in engagement with the second and third fixed contacts 28 and 30 of the first and second sets of fixed contacts 16 and 18, respectively.

The housing 12 is preferably integrally molded from a suitable nonconductive plastic material, such as a polycarbonate, and it defines an interior cavity 32 of substantially rectangular cross section. The housing 12 is substantially open at the lower end thereof, an aperture 34 is formed in the upper end of the housing 12, and a pair of apertured mounting tabs 36 extend outwardly at the opposite upper end portions of the housing 12 for securing the switch 10 to a suitable mounting structure. As illustrated in FIGS. 3 through 6, a pair of first detent elements 38 extends downwardly from the upper wall of the housing 12 adjacent opposite sides of one end of the aperture 34, and a pair of second detent elements 40 extends downwardly from the upper wall of the housing 12 adjacent opposite sides of the other end of the aperture 34.

The insert 14 is also preferably integrally molded from a suitable nonconductive plastic material, such as a polycarbonate, and it is adapted and dimensioned to be received and secured in the cavity 32 in the housing 12. The insert 14 is formed with first, second and third side cavities 42, 44 and 46, respectively, on the opposite sides thereof which are dimensioned for receiving and securing the first, second and third fixed contacts 26, 28 and 30, respectively, therein. As illustrated, the cavities 42, 44 and 46 are open at the lower ends thereof for connecting to the fixed contacts 26, 28 and 30 to conductor wires, and they are open at the upper ends thereof to permit the first, second and third fixed contacts 26, 28 and 30, respectively, to be positioned on the insert 14 so that they are engageable by the movable contacts 20 and 22. The insert 14 further includes a track 48 which segregates the first set of fixed contacts 16 from the second set of fixed contacts 18, and a pair of latch members 50 which are engageable with projections (not shown) on the interior of the housing 12 for retaining the insert 14 in the housing 12.

The first, second and third fixed contacts 26, 28 and 30 are preferably formed from a suitable conductive sheet metal, such as a silver-coated copper alloy, and each is preferably formed in a substantially closed loop, generally oval configuration. In this connection, the fixed contacts 26, 28 and 30 are adapted to be assembled in the cavities 42, 44, and 46 in the insert 14 as illustrated, and they are further adapted so that when they are assembled on the insert 14, conductor wires can be inserted through the bottom ends of the cavitis 42, 44 and 46 and received in engagement between the opposite end portions of the fixed contacts 26, 28 and 30 in order to firmly retain the conductor wires in engagement therewith. In this connection, in the switch 10 as herein embodied, the first fixed contacts 26 are formed in enlarged bifurcated configurations so that they are each adapted for receiving two conductor wires in engagement therein, whereas the second and third fixed contacts 28 and 30 are each adapted for receiving a single conductor wire therein. It will be understood, however, that other embodiments of the switch which include different combinations of single and/or bifurcated fixed contacts are contemplated. The fixed contacts 26, 28 and 30 are further adapted so that when they are assembled on the insert 14, the upper extremities of the fixed contacts 26, 28 and 30 project upwardly slightly, and the upper extremities of the fixed contacts 26, 28 and 30 are preferably of substantially smooth, rounded configuration to enable the movable contacts 20 or 22 to effectively pass thereover as the switch 10 is moved between the first and second positions thereof.

The movable contacts 20 and 22 are also preferably made from a suitable resilient conductive sheet metal, such as a silver-coated copper alloy, and each includes a contacting portion 52 and a pair of biasing portions generally indicated at 54. Each of the contacting portions 52 is of elongated configuration, and each includes a downwardly extending projection or bump 56 in the central portion thereof. The biasing portions 54 of each of the movable contacts 20 and 22 include inwardly extending portions 58 which extend inwardly in converging relation from the opposite ends of the contacting portion 52 thereof to bends 60 and outwardly extending portions 62 which extend outwardly in diverging relation from the bends 60 thereof. The movable contacts 20 and 22 are mounted in the housing 12 so that they are interposed between the slide member 24 and the first and second sets of fixed contacts 16 and 18, respectively, with the contacting portions 52 of the movable contacts 20 and 22 in biased engagement with the first and second sets of fixed contacts 16 and 18, respectively.

The slide member 24 is preferably also integrally molded from a suitable nonconductive plastic material, such as a polycarbonate, and it includes a slide portion generally indicated at 64 and a button portion 65. Formed on the underside of the slide portion 64 is a pair of recesses (not shown) which are dimensioned for receiving and positioning the terminal end portions of the outwardly extending portions 62 in order to retain the first and second movable contacts 20 and 22 in proper orientations between the slide member 24 and the first and second sets of fixed contacts 16 and 18, respectively. Formed on the upper side of the slide portion are pairs of first and second detent elements 66 and 68, respectively. In this regard, the detent elements 66 and 68 are formed in wedge-like configurations having angular upper surfaces, and recesses 70 are formed on the upper side of the slide portion 64 for defining the inner ends of the detent elements 66 and 68. The detent elements 66 and 68 on the slide portion 64 and the detent elements 38 and 40 on the housing are positioned so that the detent elements 38 and 40 are spaced apart by a greater amount than the detent elements 66 and 68 but so that the first detent elements 38 and 66 remain at least partially engaged until the second detent elements 40 and 68 are in fully engaged positions, and vice versa. The slide member 64 is received in the housing 12 so that the button portion 65 projects upwardly through the aperture 34 to enable the slide member 64 to be repositioned to move the first and second movable contacts 20 and 22 between the first and second positions thereof.

Figure 3:
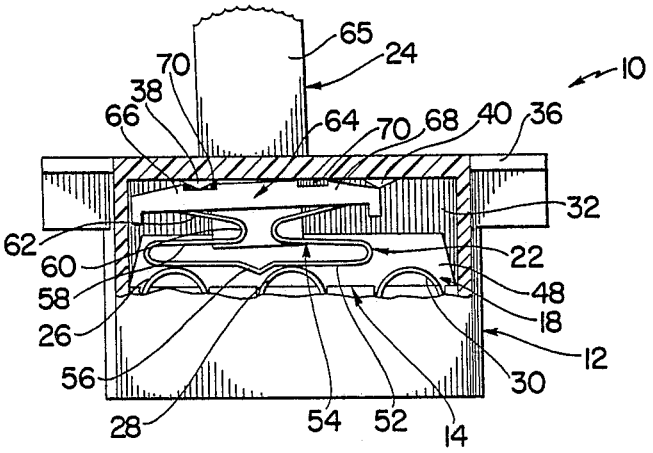
FIG. 3 is a partial sectional view taken along line 3—3 in FIG. 1 with the slide member in the first position thereof.
Figure 4:
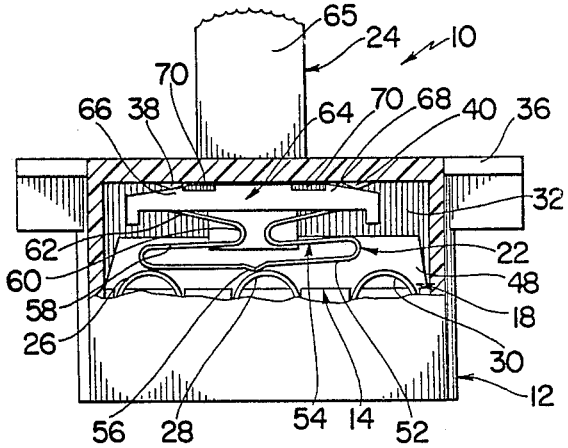
FIGS. 4 through 6 are sequential similar sectional views illustrating the operation of the switch as the slide member is advanced toward the second position thereof.
Figure 5:
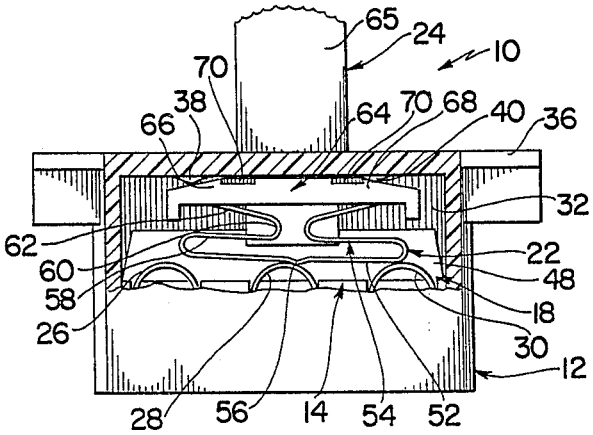
Figure 6:
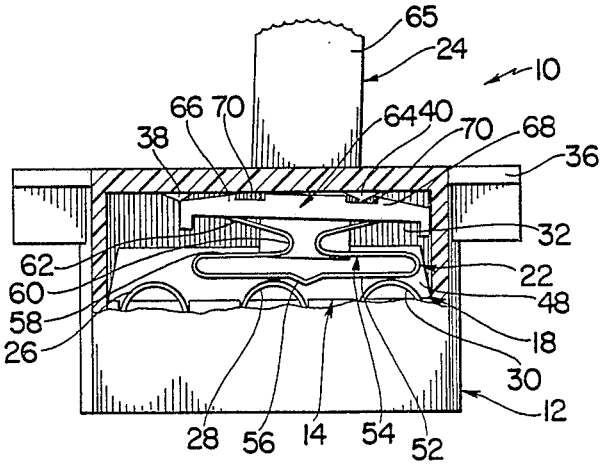

During use and operation of the switch 10, the slide member 24 is alternatively positionable in the first position illustrated in FIG. 3 or the second position illustrated in FIG. 6. As illustrated, when the slide member 24 is in the first position thereof, the contacting portions 52 of the movable contacts 20 and 22 are positioned in biased engagement with the first and second fixed contacts 26 and 28 of the first and second sets of fixed contacts 16 and 18, respectively, and the bumps 56 are positioned on the same sides of the second fixed contacts 28 as the first fixed contacts 26. Further, the first detent elements 38 on the housing 12 are received in the recesses 70 adjacent the first detent elements 66 on the slide portion 64 so that the first detent elements 38 on the housing 12 engage the first detent elements 66 on the slide portion 64 to releasably retain the slide member 24 in the first position thereof. As illustrated in FIGS. 4 through 6, as the slide member 24 is moved toward the second position thereof, the first detent elements 66 on the slide portion 64 are partially disengaged from the first detent elements 38, and the second detent elements 68 are partially engaged with the second detent elements 40, and thereafter the bumps 56 on the contacting portions 52 pass or cam over the second fixed contacts 28. In this connection, as the bumps 56 pass over the second fixed contacts 28, the first detent elements 66 on the slide member 24 remain partially engaged with the first detent elements 38 on the housing 12, and the contacting portions 52 first pivot upwardly away from the third fixed contacts 30 thereof, and then downwardly toward the third fixed contacts 30 and upwardly away from the first fixed contacts 26 thereof. As a result, the contacting portions 52 break contact with the first fixed contacts 26 well before they make contact with the third fixed contacts 30 so that the potential for arcing is effectively minimized and so that the switch is advanced toward the second position thereof with a crisp snap-action. Further, even after the bumps 56 pass over the second fixed contacts 28, the first detent elements 38 remain at least partially engaged with the first detent elements 66, i.e., detent elements 38 remain in engagement with the angular upper surfaces of the detent elements 66, to minimize the possibility of stalling in partially switched positions. However, as the slide member 24 is finally advanced to the second position thereof, the second detent elements 40 on the housing 12 pass over the second detent elements 68 on the slide portion 64 and into the adjacent recesses 70 to releasably retain the slide member 24 in the second position thereof, and the first detent elements 38 are fully disengaged from the first detent elements 66. In this regard, because the pairs of first and second detent elements 38 and 40 on the housing 12 are spaced apart by a greater distance than the pairs of first and second detent elements 66 and 68 on the slide portion 64, and because the first detent elements 38 and 66 and the second detent elements 40 and 68 are positioned so that the first detent elements 38 and 66 are not fully disengaged until the second detent elements 40 and 68 are moved into fully engaged positions, the switch 10 is operative with a sharp, crisp snap-action to further avoid arcing as the movable contacts 20 and 22 are moved over their respective sets of fixed contacts 16 and 18. Still further, because the biasing portions 54 include both inwardly extending portions 58 and outwardly extending portions 62, the biasing portions 54 effectively retain high levels of resiliency despite repeated use to provide increased durability and reliability in the switch 10, and they allow the contacting portions 52 to pivot as the bumps 56 pass over the second fixed contacts to further minimize the potential for arcing.

It is seen, therefore, that the instant invention provides an effective slide switch which can be reliably utilized for various switching applications. In this regard, the switch 10 is operative with a sharp, crisp switching action to effect switching functions without arcing. Further, the switch 10 is highly durable, and it can be effectively utilized for effecting switching functions over prolonged periods of usage; and because the housing 12, the insert 14 and the button member 24 are all made from a nonconductive plastic material, the switch 10 is not prone to dielectric breakdown. Accordingly, for these reasons as well as the other reasons hereinabove set forth, it is seen that the switch of the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A slide switch comprising a housing, spaced, substantially aligned first, second and third first contacts in said housing, a movable contact member in said housing, and slide means for slidably moving said movable contact member between a first position wherein it is in engagement with said first and second fixed contacts but in spaced disengagement from said third fixed contact and a second position wherein it is in engagement with said second and third fixed contacts but in spaced disengagement from said first fixed contact, said movable contact member being integrally formed of a resilient conductive sheet metal and including an elongated contacting portion having opposite first and second ends, said contacting position being alternatively simultaneously engageable with either said first and second fixed contacts or said second and third fixed contacts, and first and second biasing portions extending from said first and second ends, respectively, said first and second biasing portions including first and second inwardly extending portions which are spaced from said contacting portion and extend inwardly in converging relation from said first and second ends, respectively, to spaced first and second bends, respectively, and outwardly extending portions which extend outwardly in diverging relation from said first and second bends and are spaced from said inwardly extending portions , said inwardly extending portions and said outwardly extending portions cooperating to alternatively resiliently bias said contacting portion toward said first and second fixed contacts or said second and third fixed contacts.

2. In the switch of claim 1, said slide means being slidably mounted on said housing and engaging said outwardly extending portions to alternatively maintain said contacting portion in biased engagement with said first and second fixed contacts or said second and third fixed contacts.

3. In the switch of claim 1, said contacting portion having a substantially centrally disposed bump thereon, said bump extending in the direction of said fixed contacts and passing over said second fixed contact when said movable contact member is moved from said first position thereof to said second position thereof and pivoting said contacting portion toward said third fixed contact and away from said first fixed contacts.

4. The switch of claim 1 further comprising first and second detent means for alternatively releasably retaining said slide means in first or second positions thereof, respectively, wherein said movable contact member is in the first or second positions thereof, respectively.

5. In the switch of claim 4, said first and second detent means including first and second pairs of detent elements, respectively, one of the detent elements of each pair of detent elements being formed on said slide means, the other detent element of each pair of detent elements being formed on said housing, the detent elements on said housing being spaced apart by a greater distance than the detent elements on said slide means and being positioned so that one pair of detent elements is in a partially disengaged position when the other pair of detent elements is moved into a fully engaged position as said slide means is moved between the first and second positions thereof.

6. The switch of claim 3 further comprising first and second detent means for alternatively releasably retaining said slide means in first or second positions thereof, respectively, wherein said movable contact member is in the first or second positions thereof, respectively, said first and second detent means being positioned so that they are in partially disengaged positions when said bump passes over said second fixed contact.

7. In the switch of claim 6, said second fixed contact being of rounded configuration.

8. The switch of claim 1 further comprising first and second sets of said first, second and third fixed contacts in said housing and first and second movable contacts, said first and second movable contacts being movable between first positions thereof wherein they are in engagement with the first and second fixed contacts of said first and second sets of fixed contacts, respectively, and second positions thereof wherein they are in engagement with the second and third fixed contacts of said first and second sets of fixed contacts, respectively, said switch further comprising track means separating said first and second sets of fixed contacts, said first and second movable contacts traveling on opposite sides of said track means and being guided in their movement across said first and second sets of fixed contacts, respectively.

9. A slide switch comprising a housing, spaced, substantially aligned, first, second and third fixed contacts in said housing, a movable contact in said housing, slide means for slidably moving said movable contact between a first position wherein it is in engagement with said first and second fixed contacts but in spaced disengagement from said third fixed contact and a second position wherein it is in engagement with said second and third fixed contacts but in spaced disengagement from said first fixed contact, and first and second detent means for alternatively releasably retaining said slide means in first or second positions thereof, respectively, wherein said movable contact member is in the first or second positions thereof, respectively, said first and second detent means including first and second pairs of detent elements, respectively, one of the detent elements of each pair of detent elements being formed on said slide means, the other detent element of each pair of detent elements being formed on said housing, the detent elements on said housing being spaced apart by a greater distance than the detent elements on said slide means and being positioned so that one pair of detent elements is in a partially disengaged position when the other pair of detent elements is moved to a fully engaged position as said slide means is moved between the first and second positions thereof.

10. In the slide switch of claim 9, said movable contact member including an elongated metal contacting portion having a centrally disposed bump thereon, said bump extending in the direction of said fixed contacts and passing over said second fixed contact when said movable contact member is moved between said first and second positions thereof, said first and second pairs of detent elements being positioned so that both of said first and second pairs of detent elements are in partially disengaged positions when said bump passes over said second fixed contact.

11. In the switch of claim 9, said second fixed contact being of rounded configuration.

12. The switch of claim 9 further comprising first and second sets of said first, second and third fixed contacts in said housing and first and second movable contacts, said first and second movable contacts being movable between first positions thereof wherein they are in engagement with the first and second fixed contacts of said first and second sets of fixed contacts, respectively, and second positions thereof wherein they are in engagement with the second and third fixed contacts of said first and second sets of fixed contacts, respectively, said switch further comprising track means separating said first and second sets of fixed contacts, said first and second movable contacts traveling on opposite sides of said track means and being guided by said track means in their movement across said first and second sets of fixed contacts, respectively.

* * * * *